US006286410B1

(12) United States Patent
Leibolt

(10) Patent No.: US 6,286,410 B1
(45) Date of Patent: Sep. 11, 2001

(54) BUOYANTLY PROPELLED SUBMERGED CANISTER FOR AIR VEHICLE LAUNCH

(75) Inventor: Edward A. Leibolt, Wheaton, MD (US)

(73) Assignee: The United States of Americas as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/307,420

(22) Filed: May 10, 1999

(51) Int. Cl.[7] ..... F41F 3/00
(52) U.S. Cl. ..... 89/1.809; 89/1.81
(58) Field of Search ..... 89/1.809, 1.81

(56) References Cited

U.S. PATENT DOCUMENTS

| | | | | |
|---|---|---|---|---|
| 3,075,301 | * | 1/1963 | Fiedler et al. | 89/1.81 |
| 3,137,203 | * | 6/1964 | Brown | 89/1.81 |
| 3,295,411 | * | 1/1967 | Lehmann | 89/1.81 |
| 3,301,132 | * | 1/1967 | Lehmann et al. | 89/1.81 |
| 3,499,364 | * | 3/1970 | D'Ooge | 89/1.81 |
| 4,033,225 | * | 7/1977 | Kartzmark, Jr. | 89/1.81 |
| 5,076,192 | * | 12/1991 | Tegel et al. | 89/1.81 |

* cited by examiner

*Primary Examiner*—J. Woodrow Eldred
(74) *Attorney, Agent, or Firm*—Howard Kaiser

(57) ABSTRACT

The invention features a self-contained enclosure-plus-enclosed contexture and the implementation thereof in a multi-phase launching system, according to which the waterborne first phase entails naturally (buoyantly) induced motion, and at least the airborne second phase entails artificially (technologically) induced motion. Typical inventive practice provides a launch canister which is exteriorly configured to be hydrodynamically efficient while moving buoyantly upward in response to hydrostatic pressure, and which has a chamber for stowing an air vehicle. The inventive vehicle-stowing canister is released underwater so as to be buoyantly propelled upward and into the air, at which time the air vehicle is mechanistically propelled (e.g., boosted), in response to which the canister becomes disjointed cooperatively with the uncoupling of the air vehicle from the canister. The air vehicle continues to propulsively ascend, the canister's nose cone and main body gravitationally falling to the water below. Some inventive embodiments enter an airborne third phase (which, like the second phase, entails artificially induced motion), wherein the air vehicle's aerodynamic shape is adjusted (e.g., the wings are extended) and its main (self) propulsion (e.g., via propeller or jet engine) is initiated.

27 Claims, 3 Drawing Sheets

BUOYANTLY PROPELLED SUBMERGED CANISTER FOR AIR VEHICLE LAUNCH

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to methods, apparatuses and systems for launching an object, more particularly for launching an object into the air from an underwater location.

A known methodology for launching a missile or projectile from a submerged location (such as a submarine or other submersible) involves implementation of an underwater launcher similar to a torpedo tube. The underwater launcher utilizes pressurized water to force the body from the launch tube.

Another conventional methodology similarly involves implementation of an underwater launch tube, but differs in respect to propulsion. This type of system effects ignition of a rocket motor while the body is situated in the launch tube. The rocket motor thrust is used to force the body out of the launch tube, through the water column and into the air.

Of particular note herein is another type of air vehicle, viz, a flying drone (also referred to as an "Unmanned Aerial Vehicle," abbreviated "UAV"). Previously, U.S. agencies have tested and practiced the launching of UAVs from nonaqueous (e.g., land or above-water) locations. The U.S. Navy, for instance, has launched UAVs from topside locations such as ship decks; see, for example, Vogel, Steve, "Unmanned Navy Planes to Spread Wings for NATO," *The Washington Post,* Monday, Apr. 12, 1999, page A19. The U.S. Navy is presently considering the use of the above-described known underwater-to-air launching methodologies for launching UAVs from submarines.

Among the disadvantages of the above-described conventional underwater-to-air launching methodologies are (i) the requirements associated with a submerged launcher, (ii) the noise generated by the launcher, and (iii) the complexity of the system.

SUMMARY OF THE INVENTION

In view of the foregoing, it is an object of the present invention to provide efficient method, apparatus and system for launching an air vehicle from a submerged location.

It is another object of the present invention to provide such method, apparatus and system which are suitable for launching a UAV from a submersible (especially, a submarine).

The present invention provides a unique methodology for launching an air vehicle into the air from a submerged location. The inventive underwater-to-air launch system affords reliable performance in a relatively quiet, quick, uncomplicated and inexpensive manner.

According to many embodiments of the present invention, inventive apparatus comprises a structure which, in association with the liquid buoyantly propelled upward movement of said structure, is characterized by a shape which at least substantially minimizes drag and at least substantially maximizes stability. In typical inventive practice, the inventive apparatus comprises means for sensing the pressure change associated with the desubmergence of at least a portion of the structure.

Many inventive embodiments provide a system for launching a vehicle from an aquatic environment to an aerial environment. The inventive launch system comprises: a canister for containing the vehicle, the canister being configured in furtherance of reducing drag and increasing stability in relation to the upward motivation of the canister by a buoyant force in the aquatic environment; a device for releasing the canister from a location in the aquatic environment, thereby permitting the upward motivation of the canister; and, a propulsor for propelling the air vehicle from the canister, subsequent to the transition of the canister from the aquatic environment to the aerial environment.

Many embodiments of this invention provide a method for launching an object from a site below the surface of a body of water. The inventive launch method comprises: enclosing the object in an enclosure; releasing the enclosure from the site, with the object enclosed, so that the enclosure is buoyantly impelled to rise toward, through and above the surface; sensing fluid pressure relating to the fluid external to the enclosure; and, propelling the object from the enclosure once the enclosure has risen above the surface.

In practicing this invention, it is generally preferred that the canister be a kind of pressure vessel. That is, the canister should be so constructed as to withstand ambient water pressure. In particular, the canister should be made to endure at least the greatest water pressure to which the canister can reasonably be expected to be subjected.

In typical inventive practice, the canister is attached to a submersible (such as a submarine) via restraint/release apparatus—and is attached in such a manner that the canister remains appropriately distanced from the submersible and is "free-floating." Inventive practice generally dictates that the canister at least be able to withstand the ambient water pressure corresponding to the maximum water depth to which the canister will at any time be carried by the submersible.

The present invention can also be practiced, until the time of launch, whereby the canister is not in a free-floating condition while being connected to the submersible, but rather is itself enclosed and thereby isolated from the surrounding water. For example, such a "superenclosure" for the canister can have an upper hatch (e.g., at an upper end of the superenclosure) and a lower hatch (e.g., at a lower end of the superenclosure). The inventive practitioner(s) can gain access to the canister via the lower hatch. The canister is releasable so as to exit the superenclosure via the upper hatch. According to many such inventive embodiments, a restraint/release mechanism is provided within the superstructure. To inventively launch the canister, the superstructure is flooded. While the canister is inside the superstructure, the canister is released, whereupon the buoyant force on the canister inside the superstructure propels the canister upward and through the superstructure's upper hatch. Once the canister has exited the superstructure, the buoyant force on the canister continues to propel the canister upward in typical inventive fashion.

Generally, regardless of whether an inventive embodiment is of the "free-floating" kind or the "superenclosure" kind, the inventive principle obtains that the canister should at least be able to withstand the ambient water pressure corresponding to the maximum water depth to which the canister will travel. According to inventive "superenclosure" embodiments, the canister will be subjected to an aqueous ambience at a depth no greater than the actual launch depth; hence, the canister must withstand the ambient water pressure existing at launch depth. According to inventive "free-floating" embodiments, the canister may be subjected to an aqueous ambience at depths no greater than the actual launch depth; hence, the canister must withstand the ambient water pressure existing at these greater depths. However, as a practical matter, many inventive "free-floating" embodiments do not cause the canister to be subjected to an aqueous ambience at a depth greater than the actual launch depth.

Selection of the material composition of the canister may vary in accordance with the particular inventive application. Most inventive embodiments will provide a canister made of a metal material (e.g., steel, titanium, aluminum and/or another metal) or a composite material (e.g., a fiber-reinforced matrix material), or some combination thereof. The three main components of many inventive canister embodiments are the cylindrical body, the nose cone and the stabilizers (e.g., fins)—each of which can be composed of metal material and/or composite material.

A typical arrangement of a fiber-reinforced matrix material is one which comprises a resin (such as an epoxy resin) and fiberglass material (such as a fiberglass mat) which is disposed within the resin. Glass-reinforced plastic (abbreviated "GRP"), for instance, is a type of fiber-reinforced matrix material with which ordinarily skilled artisans are well acquainted.

Usually, this invention will require that the canister be reinforced, in order to be able to withstand the anticipated water pressures. If the canisters cylindrical main body is made entirely of metal, for example, the canister can be reinforced with metal internal circumferental reinforcing rings. As another example, if the canister's cylindrical main body is made of a fiber-reinforced composite material (e.g., GRP), the fibrous material itself (e.g., the glass) can afford the reinforcement of the canister.

Another guiding principle for practicing inventive construction of the canister may be: The lighter the canister, the heavier the potential payload. Therefore, utilization of lighter metals such as titanium and aluminum, and/or of many fiber-reinforced composites, would tend to permit inventive launching of heavier payloads.

As distinguished from the inventive canister's cylindrical main body (which must be hollow so as to accommodate the air vehicle), the inventive canister's nose cone need not be provided with an interior space for stowing purposes. Therefore, some inventive embodiments provide a nose cone which constitutes a solid or substantially solid piece. Alternatively, some inventive embodiments provide a nose cone which is hollow, wherein a syntactic foam fills the nose cone's cavity. In any case, the nose cone's construction is generally subject to the inventive requisites that the nose cone be capable of withstanding the ambient water pressure to which the nose cone is anticipated to be subjected, and that the nose cone accommodate the pressure sensing means.

The terms "air vehicle," "aero vehicle" "and aerial vehicle," as used herein in association with applicability of the present invention, each broadly refer to any object which moves in or through the air, or which can be caused to move in or through the air—regardless of when, where or how such object ceases to move. Included among the types of air vehicles which are possibly associated with inventive practice are rockets, missiles, projectiles, manned airplanes, unmanned airplanes (such as UAVs), manned helicopters, unmanned helicopters, and other aircraft.

The terms "submerged location" or "underwater location," as used herein in association with applicability of the present invention, broadly refer to any liquid location, especially to any aquatic location. Generally, in inventive practice, such an aquatic location can be any location beneath the surface of any body of water, including but not limited to any such location associated with an ocean, a sea, a gulf, a lake, a river, etc.

It is conventionally understood, by students of physics and fluid mechanics, that a resultant vertically upward force is exerted on a body by a fluid (e.g., a static fluid) in which the body is submerged or floating. Synonymously or interchangeably, the terms "buoyancy," "buoyant force" and "upthrust" are conventionally used to refer to the force (e.g., hydrostatic force) exerted vertically upward by a fluid on a body which is completely or partially immersed in the fluid. According to Archimedes' Principle, the magnitude of the buoyant force is equal to the weight of the fluid displaced by the body. Considered another way, due to fluid pressure, the weight of the body is decreased by an amount equal to the buoyant force.

The term "fluid pressure" is conventionally understood to refer to the pressure exerted by a liquid or a gas. At any point in the fluid, fluid pressure acts in all directions. Theoretically, when a body is partly or fully immersed in a static fluid, every part of the body surface in contact with the fluid is pressed upon by the fluid. The pressure is greater on the areas of the body which are more deeply immersed. The overall result of all of these individual fluid pressure forces is the buoyant force.

Air and water both exert fluid pressure: Air exerts air pressure; water exerts fluid pressure. Generally, in a situation wherein air is present above water, the water pressure at a particular point increases in direct proportion to the depth of that point below the water surface; the air pressure at a particular point decreases in direct proportion to the height of that point above the water surface. Nevertheless, the difference between the water pressure just below the water surface and the air pressure just above the water surface is marked; that is, the air pressure is significantly less than the water pressure.

Typical inventive embodiments operate in at least two phases. The first phase is associated with the "natural" propulsion caused by a buoyant force. Following the first phase, the second phase is associated with the "artificial" propulsion caused by a man-made force such as involving mechanical, electromechanical and/or chemical technology. For some inventive embodiments, a third phase (following the second phase) is associated with "artificial" propulsion for autonomously propelling the air vehicle.

The first inventive phase involves the launching of a unit comprising an enclosure and an object enclosed thereby; the enclosure is contoured for promoting hydrodynamic efficiency while the enclosure travels upward through the water column as a consequence of being concurrently subjected to an upward liquid buoyant force.

The second inventive phase involves the launching of the object from the unit once the unit is airborne; the object is technologically propelled so as to separate from the enclosure, which itself is capable of disjoining so as to permit such separation.

According to some inventive embodiments, a third inventive phase is entered wherein the air vehicle's shape is adjusted (e.g., the wings are extended) for aerodynamic flight, and self-propulsion (e.g., via propeller engine or jet engine) of the air vehicle is effected. This third-phase self-propulsion is of the kind which affords the air vehicle the capability of sustaining flight.

In the light of this disclosure, it will be apparent to the ordinarily skilled artisan that the present invention can variously practice the phase or phases which involve artificial propulsion, and in various combinations and permutations. Any inventive phase subsequent to the first stage can involve any form of artificial propulsion in a manner which is concordant with the principles of the present invention. For example, if the air vehicle is a multi-stage rocket, the invention's second phase can entail the firing of the rocket's first stage, the invention's third phase can entail the firing of the rocket's second stage, etc.

The present invention lends itself to launching any type of air vehicle, including but not limited to missiles, projectiles, rockets, aircraft and other aerodynamically shaped (e.g., winged) air vehicles, either manned or unmanned (such as UAVs). According to this invention, an aircraft can be any machine capable of atmospheric flight, such as an airplane (propelled by jet engine or propeller), a helicopter, a glider or a lighter-than-air vehicle. Moreover, the present invention lends itself to launching an air vehicle from any aquatic location, or to any location beneath the surface of any body of water, including but not limited to submersibles such as submarines.

Although usual inventive practice will involve the launching of an unmanned air vehicle, the present invention is conceivably applicable to the launching of a manned aircraft, such as an airplane (propelled by jet engine or propeller), a helicopter, a glider or a lighter-than-air vehicle. In fact, the present invention is conceivably applicable to the launching of spacecraft.

The inventive launching of a manned air vehicle will generally be more problematical that that of an unmanned air vehicle; in particular, manned air vehicles can generally be expected to require canister sizes and launch depths which are considerably greater than required for unmanned air vehicles.

Inventively featured is the implementation, in the context of the inventive multi-phase launch system, of a self-contained unit which comprises a hydrodynamically shaped enclosure and the contents enclosed thereby, such enclosed contents including an air vehicle along with parts and components pertaining to pressure sensing, control and propulsion. In frequent inventive practice, two different kinds of propulsion are effectuated, viz., propulsion pertaining to second-phase boosting of the air vehicle, and propulsion pertaining to third-phase flight sustenance of the air vehicle.

Typical embodiments of the present invention implement a low-drag pressure-vessel enclosing structure (e.g., a canister). The canister has a cylindrical main body, a nose cone and stabilizers (e.g., fins). Stowed inside the cannister is an air vehicle. Prior to launch, the cannister is secured to the submarine via a "launch pad analogue" (e.g., a mechanism which is capable of holding the canister and then liberating the canister) and is hydrodynamically stabilized.

Many inventive embodiments are particularly well suited for launching a winged air vehicle such as a UAV. According to such inventive embodiments, the stowed winged air vehicle is preferably characterized by foldable wings for achieving the requisite compactness for being stowed in the canister's interior space. The winged air vehicle is compactly situated, wings folded, within the canister's compartment. The inventive encapsulation of an airplane-type vehicle by a canister advantageously permits the canister, rather than the airplane-type vehicle, to determine the hydrodynamic and buoyant characteristics associated with the buoyantly propelled ascension of the enclosed airplane-type vehicle.

The canister (which carries the winged air vehicle within its interior space) is launched upon actuation of the release function of the restraint/release apparatus, whereupon the canister is no longer restrained by the restraint/release apparatus and is buoyantly propelled approximately vertically upward. The canister continues to ascend underwater, approaching and eventually reaching the water surface while moving in an approximately vertically upward direction.

The canister's nose cone has embedded therein a pressure sensor (e.g., pressure transducer). As the canister exits the water, the pressure transducer senses the pressure drop (associated with the air vis-a-vis' the water) and sends an electrical signal to a control unit such as a control box. This pressure sensing occurs when the nose cone (or a portion thereof) pierces the water surface, thereby transitioning from the water environment (beneath the water surface) to the air environment (above the water surface).

Upon receipt of the electrical signal (relating to the pressure sensing), the controlling component of the control box "throws" an ignition switch, thereby sending current from a power supply (e.g., an ignition battery) to an electrical ignitor in a solid rocket motor, placed at the aft end of the winged air vehicle. The motor ignites and forces the air vehicle out of the canister and into the air in a vertically upward direction; in effect, as this occurs, the air vehicle pushes upward against the canister's nose cone and downward against the canisters main body, thereby effecting separation of the canister's nose cone and the cannister's main body from each other, and concomitantly effecting separation of the air vehicle from the canister's nose cone and the canisters main body.

The canister's nose cone and the canister's main body fall back to the water and sink. Meanwhile, the air vehicle continues to climb while traveling an approximately vertically upward direction. After the motor is expended (for instance, at the point at which the air vehicle has attained an altitude for sustained flight), the air vehicle's wings are rotated into a flight position and the air vehicle's main propulsion unit is started. The air vehicle then descends until lift is generated on the wings. At this point, the air vehicle is effectuating controlled, powered flight.

The present invention features the utilization of the naturally occurring physical phenomenon, mentioned hereinabove, known as "buoyancy." According to this invention, a canister is upwardly propelled by a buoyant force on the canister. In particular, the present invention features a hydrodynamically shaped canister exterior, suitable for effectuating such buoyancy. The exterior surface of the canister is configured in furtherance of hydrodynamic and buoyant efficiency in terms of reduced drag and increased stability. Further inventively featured is the canister's enclosure of a compactable (e.g., foldable) air vehicle, which is situated inside an interior compartment of the canister.

It may be desirable to avoid submergence of all or part of the air vehicle. Advantageously, according to typical embodiments of the present invention, the canister entirely protects the air vehicle from exposure to a water environment.

The present invention is especially efficacious in terms of availing itself of buoyancy as a natural physical launch force. The inventive practitioner can exercise conformal or adaptive selectivity with respect to the entire external size and shape of the cannister, as well as with respect to the overall weight distribution (including, e.g., internal ballast and trim) of the vehicle-carrying canister (i.e., the air vehicle/launch canister unit).

In typical inventive practice, due to the canister's hydrodynamically favorable size, shape and weightedness, after being released from an underwater location the canister progressively gains speed (in other words, increases velocity, or accelerates) in an upward direction. During the buoyantly propelled upward movement of the canister, the canister is undertaking a kind of "flight path." The canister moves in an upward path which is, to at least some degree, straight (linear).

To elaborate at a basic level on the buoyantly propelled canister's flight path, the canister will initially travel upward at an approximately constant acceleration. According to some inventive embodiments, the canister will essentially continue in this constantly accelerating mode until reaching the water surface. When the canister reaches the water surface, this velocity represents the speed of the vehicle-carrying canister when exiting the water.

According to other inventive embodiments, the canister will essentially continue in its flight path in a constantly accelerating mode until reaching a point at a certain depth below the water surface; at this point, the drag force upon the canister is equal to the buoyant force upon the canister. The velocity which the canister attains at this equilibrium point is a type of "terminal velocity." At the terminal velocity point, the canister ceases to accelerate. From the terminal velocity point onward (upward), the canister will essentially travel at a constant velocity (the terminal velocity) until reaching the water surface. The terminal velocity represents the speed of the vehicle-carrying canister when exiting the water.

The inventive practitioner can select certain characteristics in order to control the speed of the vehicle-carrying canister when exiting the water; this water exit speed can be inventively controlled by adjusting parameters among which are the following: (i) the depth of the vehicle-carrying canister when launched; (ii) the buoyancy of the vehicle-carrying canister; and, (iii) the hydrodynamic drag of the vehicle-carrying canister. Properties which pertain to hydrodynamic and buoyant efficiency include the exterior size, exterior shape and overall weight (or mass) distribution of the vehicle-containing canister.

Of particular note, many inventive embodiments provide a canister having an elongated or oblong shape (especially, a substantially cylindrical or cylinder-like or cylindroid shape). It is therefore desirable for the vehicle-carrying canister to move approximately vertically upward in a stable manner, whereby the canister's nose cone is pointed vertically upward, and whereby the canister's imaginary longitudinal axis is approximately vertical and in approximate coincidence with the path of the canister. Inventive implementation of stabilizing structure (such as fins) as part of the overall canister structure can further stability of the canister.

The canister's upward speed resulting from the liquid buoyant force is an important consideration in the "physics" pertaining to the first phase of inventive practice. In the light of this disclosure, the ordinarily skilled artisan who practices the present invention should be capable of assessing how to effectively bring about the upward liquid buoyant propulsion, especially so that the vehicle-containing canister is traveling sufficiently fast at the point at which it penetrates the water surface.

For most inventive embodiments, it is preferable that the vehicle-containing canister is traveling at a sufficient speed (otherwise stated, has gathered sufficient momentum) when exiting the water so that the vehicle-containing canister becomes completely airborne (i.e., "leaps" out of the water). In terms of separation of the vehicle from the vehicle-containing canister, the second inventive phase is better effectuated once the vehicle-containing canister has completely cleared the water; otherwise, the water may functionally impede or impair the separation of the vehicle from the vehicle-carrying canister.

Accordingly, inventive second-phase propulsion should be performed before the vehicle returns to the water, due to gravity. In particular, the inventive second phase propulsion should preferably occur before the vehicle reaches the in-air apex of its first-phase buoyantly propelled launch, while the vehicle has substantially retained its upward impetus and verticality. Waiting too long to propel the vehicle from the canister can render the vehicle misdirected or off-course because of unwanted effects of aerodynamic and/or gravitational forces.

Hence, the present invention beneficially obviates the need for providing an "artificial" physical launch force below water. A main advantage of this invention therefore lies in its utilization of an inherent buoyant launch force, without the aid of an artificial force (e.g., an external mechanical force), for purposes of launching the vehicle-carrying canister from a submerged location and into the air.

Moreover, the inventive methodology advantageously produces less underwater noise than is produced by other launch methodologies (such as those involving pressurized water launchers, or those involving canister propulsion motors).

Further inventively featured is the sensing of air in the vicinity of the canister's nose cone, and the consequent separation of the canister from the vehicle when the canister has become airborne. This inventive feature of pressure-sensing/component-separation in relation to the canister's airborne status contributes to the invention's simplicity, rapidity, cost-effectiveness and reliability.

In a more general sense, the present invention features the sensing of the environmental condition, outside the canister, in terms of whether such environmental condition is water or air. Frequently in inventive practice, this sensing of the aqueous-versus-aerial environmental condition is preferably accomplished by sensing fluid pressure relating to the environmental condition outside the canister.

The expenses associated with inventive practice should generally prove economical in comparison with the expenses associated with known underwater launch techniques. The invention's systematically controlled air vehicle propulsion can implement readily available parts and components. Even the inventive cannister can "borrow" one or more fluid dynamic structural sections or appendages from conventional devices such as rockets, missiles and torpedoes.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

As elaborated upon hereinbelow, FIG. 2*a*, FIG. 2*b*, FIG. 2*c*, FIG. 2*d*, FIG. 2*e* and FIG. 2*f* together constitute a schematic sequential representation of an embodiment of an underwater-to-air launch, in accordance with the present invention, of the air vehicle/launch canister unit shown in FIG. 1.

Figure 1:
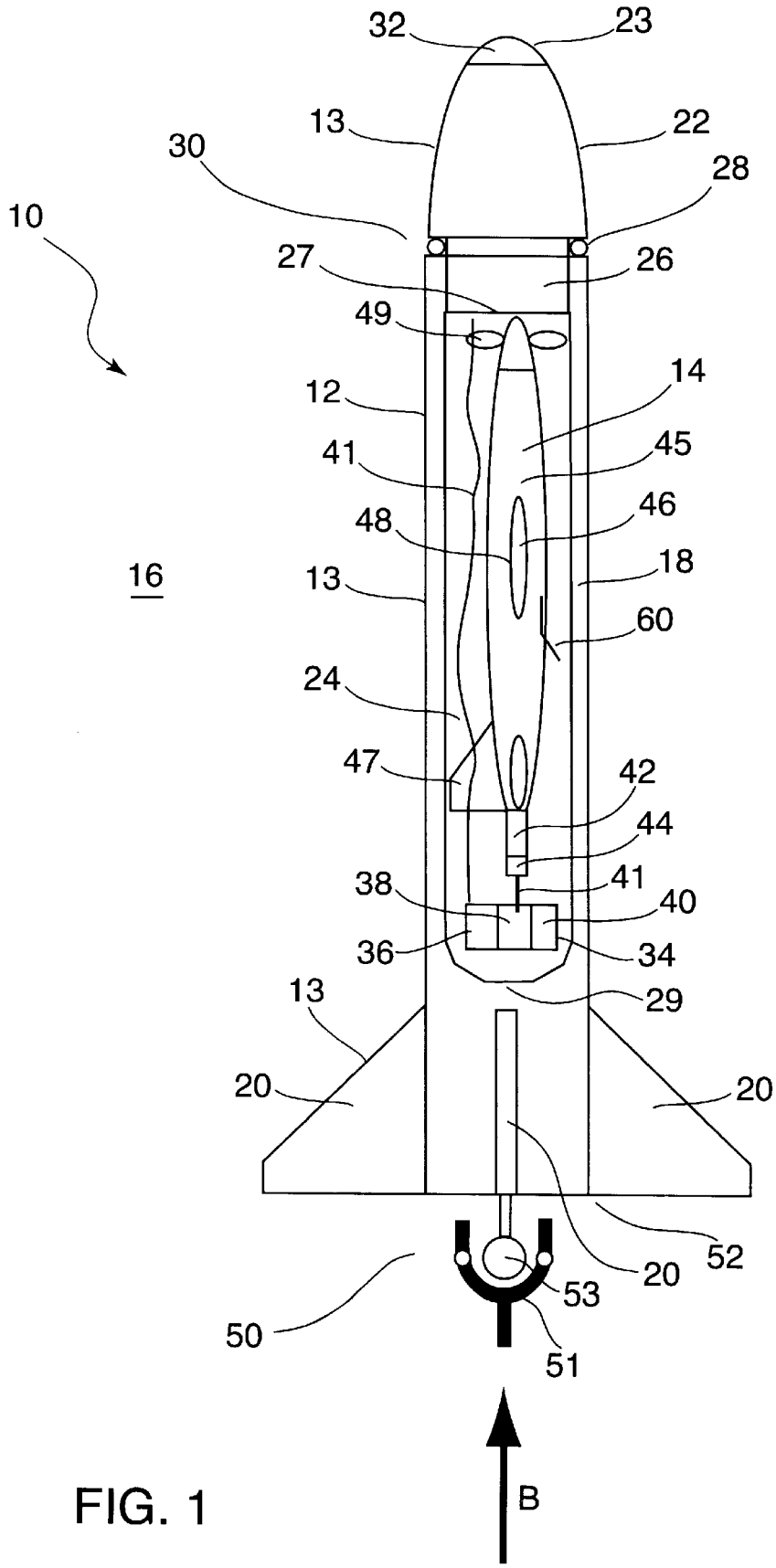
FIG. 1 is a diagrammatic cutaway elevation view of an embodiment of an air vehicle/launch canister unit which is ready for launch, in accordance with the present invention, wherein the air vehicle/launch canister unit is shown comprising the combination of a launch canister and an air vehicle contained therein.
Figure 2E:
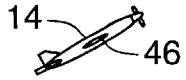
Figure 2F:
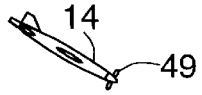
Figure 2D:
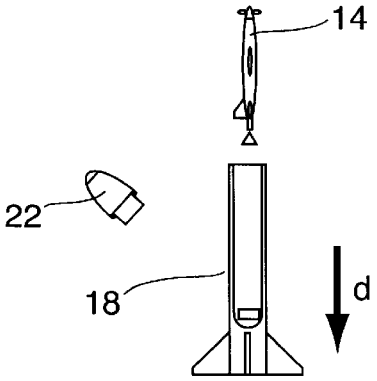
Figure 2C:
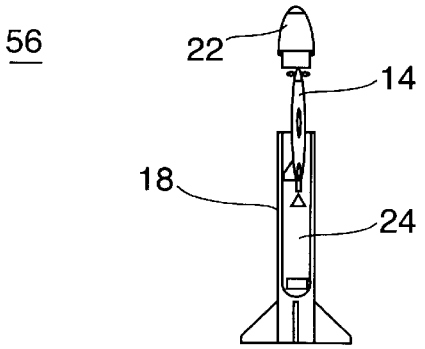
Figure 2B:
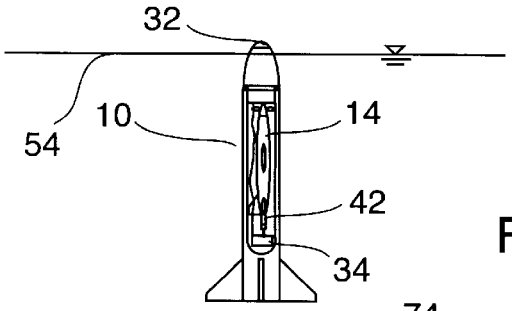
Figure 2A:
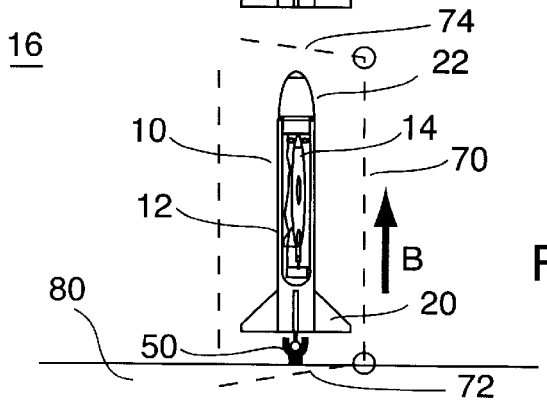

FIG. 2*a* is a scaled down version of the view of the air vehicle/launch canister unit shown in FIG. 1. The air vehicle/launch canister unit is shown more deeply submerged in FIG. 2*a* than shown in FIG. 2*b*. A buoyant force is shown exerted with respect to the air vehicle/launch canister unit. As shown in FIG. 1 and FIG. 2*a*, the air vehicle/launch canister unit is connected to a restraint/release mechanism, and the air vehicle (an unmanned aero vehicle) is in a folded state, enclosed by the launch canister.

FIG. 2*b* shows the air vehicle/launch canister unit having ascended to a shallower water depth than shown in FIG. 2*a*, with the tip of the nose cone exposed to the air, thereby permitting sensing of reduced pressure, thus resulting in the ignition of the air vehicle's rocket motor. The buoyant force shown in FIG. 2*a* is continually exerted during submergence of the air vehicle/launch canister unit or any portion thereof. FIG. 2*b* is diagrammatically representative of the approximate stage of the inventive launch wherein: the pressure sensor senses little or no pressure after leaving the water; the pressure sensor sends one or more corresponding signals to the control box; the control box sends ignition current to the rocket motor ignitor; and, the rocket motor ignites.

FIG. 2*c* shows, in the air, the separating of the air vehicle from the launch canister's main body and nose cone. As shown in FIG. 2*c*, the air vehicle pushes, approximately simultaneously and in approximately opposite directions, against the canister's nose cone and against the canister's main body, thereby effecting separation.

FIG. 2*d* shows the complete separation following the separating shown in progress in FIG. 2*c*. The air vehicle is shown in FIG. 2*d* to have ascended to a higher altitude than shown in FIG. 2*c*. Shown in FIG. 2*d* are the continued rising of the air vehicle, and the falling of the canister's main body and the canister's nose cone (eventually reaching the water and sinking therein).

FIG. 2*e* shows the air vehicle at an moderately ascending attitude, the air vehicle having ascended to a higher altitude than shown in FIG. 2*d*. FIG. 2*e* is diagrammatically representative of the approximate stage of the inventive launch wherein the air vehicle has climbed to a height typically of a few or several hundred feet (e.g., 500 feet), and wherein occurs the cessation (cut-off) of the air vehicle's rocket motor, and the rotation of the air vehicle's wings to fly position. This leads to the reorientation of the air vehicle toward horizontal attitude, to be followed by the moderately descending attitude shown in FIG. 2*f*.

FIG. 2*f* shows the air vehicle at an moderately descending attitude. FIG. 2*f* is diagrammatically representative of the approximate stage of the inventive launch wherein occurs the activation (start-up) of the air vehicle's main propulsion system.

Figure 3:
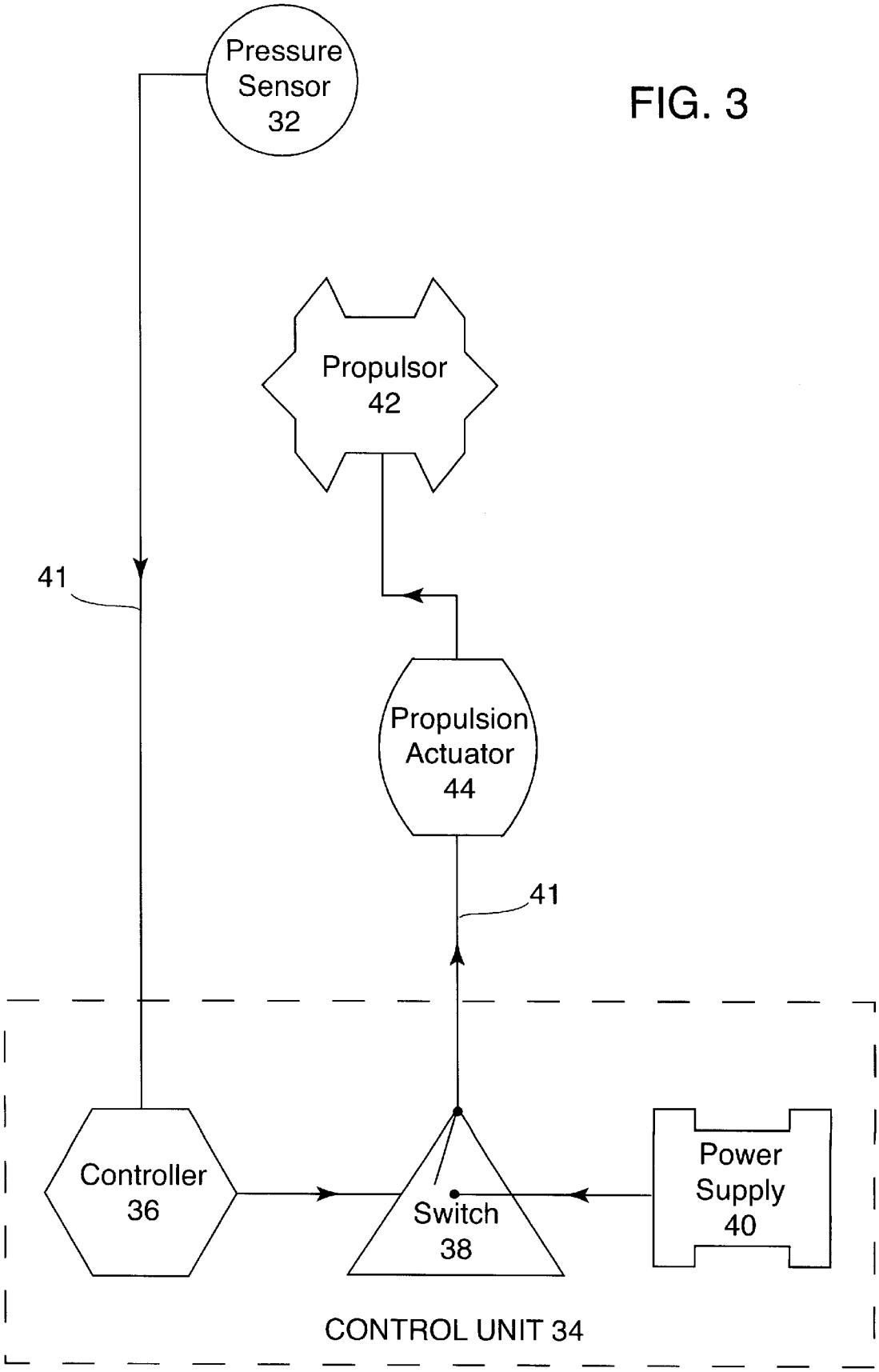

FIG. 3 is a schematic representation, relating especially to FIG. 2*b* and FIG. 2*c*, of an embodiment of an inventive control system.

DETAILED DESCRIPTION OF THE INVENTION

Referring now to FIG. 1, inventive air vehicle/launch canister unit 10 comprises launch canister 12 and air vehicle 14. FIG. 1 can be considered to show vehicle/canister unit 10 submerged in water 16 in a launch-ready position, vehicle/canister unit 10 accordingly being naturally subjected to buoyant force B.

Pressure vessel launch canister 12 includes an approximately cylindrical (metal or composite) canister body 18, a set of three stabilization fins 20, and a nose cone 22. The outside surface 13 of canister 12—including that of canister body 18, stabilization fins 20, and nose cone 22—is hydrodynamically shaped for low hydrodynamic drag so as to allow maximum (or near maximum) speed to be obtained for a given water depth. The exterior surface configuration of canister 12 is designed to be hydrodynamically efficient (especially in terms of decreasing drag and increasing stability) while canister 12 is moving buoyantly upward in response to hydrostatic pressure.

Stabilization fins 20 serve to stabilize canister 12 for a near vertical launch path. For many inventive embodiments, three is an appropriate number of fins 20 insofar as accomplishing adequate stabilization without incurring undue drag. Metal or composite canister body 18 contains a hollow, payload cavity 24, for stowage of air vehicle 14. Canister body 18 is reinforced for deep water pressures. Nose cone 22 has a machined shoulder 26, which allows for the installation of an O-ring seal 28. Shoulder 26 includes a bottom side 27 which is approximately or generally planar, and which is approximately perpendicular to the imaginary longitudinal axis of canister 12.

Nose cone 22 is analogous to a typical nose cone which constitutes the forwardmost section of a rocket or guided missile. A conventional nose cone is typically shaped to offer minimum aerodynamic resistance. Similarly, nose cone 22 constitutes the forwardmost section of launch canister 12, and is shaped to offer minimum hydrodynamic resistance.

At the upper end 30 of canister body 18, nose cone 22 is inserted into canister body 18, and is sealed against water pressure by O-ring seal 28. Canister body 18 and nose cone 22 are rendered secure, but separable, with respect to each other.

Nose cone 22 has, proximate its tip 23, an embedded pressure transducer 32 which is calibrated to sense pressure range from launch site to water exit. Pressure transducer 32 is sensitive to such change in conditions (e.g., water surroundings versus air surroundings) as would effect change in pressure. The output of pressure transducer 32 is transmitted to a control box 34; more specifically, the output of pressure transducer 32 is transmitted, via conducting wire 41, to an electrical or electronic controller 36. Control box 34 includes a controller 36, a rocket motor ignition switch 38 and an ignition battery 40.

Air vehicle 14 includes wings 46 and control surfaces 48 (such as flaps, ailerons, rudders, etc.) which are movable, adjustable, retractable, rotatable, pivotable, flexible, foldable or otherwise compliant to allow stowage within payload cavity 24. Air vehicle 14 also includes a fuselage 45, a tail section 47, a propeller 49 (which is associated with its main propulsion system), and (if air vehicle 14 is a UAV) a radio antenna 60 (which is associated with remote control of air vehicle 14). Air vehicle 14 shown in the figures is an unmanned aero vehicle (UAV), depicted in a folded condition in FIG. 1, FIG. 2*a* and FIG. 2*b*.

Solid rocket motor booster 42 is attached to air vehicle 14 at the rear of air vehicle 14. Solid rocket motor booster 42 includes an electrical resistance solid rocket motor ignitor 44. Controller 35 controls ignition switch 38 whereby the actuation of ignition switch 38 causes the electrical circuit to close, thereby permitting electrical current to flow, via conducting wire 41, from ignition battery 40 to motor ignitor 44, thereby starting rocket motor 42.

The resultant canister/vehicle unit 10 system is ballasted to be buoyant, and is trimmed for an upright position.

The ordinarily skilled artisan who reads this disclosure appreciates the diagrammatic nature of FIG. 1 and FIG. 2*a* through FIG. 2*f*. In particular, FIG. 2*a* through FIG. 2*f* are not intended to be a scale representation of an actual inventive launch in terms of distances between objects, or distances of objects below or above water surface 54.

For instance, the ordinarily skilled artisant readily understands that vehicle/canister unit 10 shown in FIG. 2*a* can be submerged at various depths, including much greater depths than diagrammatically depicted in the overall scheme of FIG. 2*a* through FIG. 2*f*. In inventive practice, the launching depth of vehicle/canister unit 10 shown in FIG. 2*a* is limited only by considerations of technological feasibility in terms of increasing water pressure, e.g., by how deeply a submarine can dive. Similarly, in inventive practice, the "sky is the limit" with regard to how high air vehicle 14 shown in FIG. 2*e* and FIG. 2*f* maximally ascends.

Still with reference to FIG. 1 and also with reference generally to FIG. 2*a* through FIG. 2*f*, vehicle/canister unit 10 is launched from a remote underwater location using a restraint/release mechanism 50, situated at the lower end 52 of canister body 18. Restraint/release mechanism 50 serves to restrain vehicle/canister unit 10 until such moment as its release is desired.

According to generally preferred inventive practice, vehicle/canister unit 10 is attached to foundation 80 in proximity thereto so as to be freely movable (e.g., so as to have three degrees of freedom). For many inventive embodiments, vehicle/canister unit 10 is just sufficiently distanced from foundation 80 so that vehicle/canister unit 10 can be freely floated and then released. For instance, vehicle/canister unit 10 can be attached to foundation 80 via a restraint/release mechanism 50 so as to be rotatably or pivotably movable in every direction, subject to mechanical constraints.

Vehicle/canister unit 10 is shown in FIG. 1 and FIG. 2*a*, in accordance with generally preferred inventive practice, to be closely coupled with a foundation 80 (such as diagrammatically indicated in FIG. 2*a*) so that vehicle/canister unit 10 exists in a freely floating immersed condition in water 16. Readily envisioned is an alternative kind of inventive embodiment wherein vehicle/canister unit 10 is surrounded by an auxiliary structure such as a sealable superstructure 70 which is diagrammatically indicated by dashed line in FIG. 2*a*. Superstructure 70: Communicates at its lower superstructure doored/portaled end 72 with a submersible (e.g., submarine), thereby permitting access; can be flooded by opening its upper superstructure doored/portaled end 74 of the superstructure; and, once flooded, permits discharge of buoyantly propelled vehicle/canister unit 10 through upper superstructure doored/portaled end 74.

Especially in military applications, wherein a conventional approach is to "fair" a submersible (e.g., submarine, the hydrodynamic efficiency of the submersible may be of import. It may be preferable to practice this invention so that freely floating vehicle/canister unit 10 remains at least substantially within a free-flood area—i.e., at least substantially within the flow lines of the submersible's hull. For instance, vehicle/canister unit can be at least partially disposed within a recess provided in the submersible. If at least a portion of vehicle/canister unit 10 is outside the flow lines, vehicle/canister unit 10 can undesirably cause drag, collide with an entity, or act as a sort of moment arm. If an auxiliary structure such as a superstructure 70 is inventively implemented, similar considerations may apply.

According to the majority of inventive embodiments, launch canister 12 of vehicle/canister unit 10 is freely movable while being "hard-mounted," via apparatus such as restraint/release mechanism 50, onto or in association with a foundation 80 such as a submarine or other kind of submersible. Some inventive embodiments provide for such a firm connection with respect to a "towed buoy" (e.g., a buoy towed by a submarine). It is also possible for this invention to be practiced whereby vehicle/canister unit 10 is firmly connected with respect to a fixed or stationary underwater location. Although not believed to be preferred inventive practice, it is also conceivable for vehicle/canister unit 10 to be tethered with respect to a foundation.

The ordinarily skilled artisan is well acquainted with various known devices and techniques for effectuating releasable restraint such as would be suitable for inventive practice involving some type of restraint/release mechanism 50. The restraint/release mechanism 50 shown in FIG. 1 and FIG. 2*a* is shown to be of the ball-and-socket type, thus affording, within certain limitations, pivotable or rotatable motion in every direction. For instance, a socket-like member 51 (which is attached at the underwater launch point, e.g., to a submarine) is in engagement with the extreme spherical portion of projection 53 (which is attached to canister body 18 at lower end 52).

Referring to FIG. 2*a* and FIG. 2*b*, once vehicle/canister unit 10 is released via restraint/release mechanism 50, the natural buoyant force B pushes vehicle/canister unit 10 upward toward water surface 54, whereupon vehicle/canister unit 10 breaks water surface 54.

The inventive practitioner can control the speed of vehicle/canister unit 10 at the time that vehicle/canister unit 10 breaks water surface 54 (i.e., exits water 16). This water exit speed can be inventively controlled by adjusting certain parameters, including the following: (i) the depth of the launch of vehicle/canister unit 10; (ii) the buoyancy of vehicle/canister unit 10; and, (iii) the hydrodynamic drag of vehicle/canister unit 10.

As shown in FIG. 2*b*, when vehicle/canister unit 10 breaks water surface 54, at least a portion of nose cone 22 is exposed to the air 56, whereupon pressure transducer 32 senses little or no pressure. This sensing by pressure transducer 32 of significant change in pressure corresponds to the penetration of water surface 54 by nose cone 22 or a portion thereof; that is, the part or area of nose cone 22 which is pressure-sensitive (via pressure transducer 32) experiences change from the water 16 region to the air 56 region.

Reference also being made to FIG. 3, pressure transducer 32 transmits to controller 36 (of control box 34) a signal informing of such pressure change relating to environmental change from water to air. In response to this signal, controller 36 turns on ignition switch 38 (of control box 34) and thus sends electrical current from ignition battery 40 (of control box 34) to motor ignitor 44, whereupon rocket motor 42 activates.

Reference now being made to FIG. 2*c*, the activation of rocket motor 40 forces air vehicle 14 out of canister 12. Canister 12 is designed, in response to the forcible exertion by air vehicle 14, to disjoin at the junction where nose cone 22 joins canister body 18, thereby facilitating the uncoupling of air vehicle 14 from canister 12.

Still referring to FIG. 2*c*, upon ignition of rocket motor 40, air vehicle 14 is forced out of canister 12 and into the air in a vertically upward direction. During such occurrence, air vehicle 14 exerts an upward force against nose cone 22 and a downward force against canister body 18. More specifically, during such occurrence, air vehicle 14 exerts, from within canister 12, an upward force against bottom side 27 (of nose cone 22), and a downward force against lower interior end 29 of cavity 24 (inside canister body 18). Separation is thereby effected, with respect to one another, of air vehicle 14, nose cone 22 and canister body 18, which proceed in divergent directions as shown in FIG. 2*d*. Air vehicle 14 continues to travel upward. Due to force of gravity, nose cone 22 and canister body 18 each fall generally downward as indicated by arrow d.

Generally in accordance with many embodiments of the inventive launch system, during the period prior to separation such as shown in FIG. 2*d*, the buoyantly propelled upward movement of vehicle/canister unit 10 approximately defines a vertical direction. The canister's approximately cylindrical main body 18 approximately defines a longitudinal axis. This longitudinal axis (defined by canister body 18) and this vertical direction (defined by the upward movement of vehicle/canister unit 10) are approximately coincident.

Referring to FIG. 2*d*, air vehicle 14 continues to ascend approximately vertically upward (in a nose up attitude) until booster motor 40 burns out. For some inventive embodiments motor 40 burnout occurs at an altitude on the order of 500 feet.

With reference to FIG. 2*e*, at such point in time in which motor 40 terminates operation (because of fuel exhaustion or shutoff), wings 46 and control surfaces 48 rotate into flight position. Air vehicle 12 is shown in FIG. 2*e* at an acute inclination, having changed from the approximately vertical attitude shown in FIG. 2*d*. During the period of time which takes place between FIG. 2*e* and FIG. 2*f*, air vehicle 14 changes from the positively acute inclination (obliquely ascending attitude) shown in FIG. 2*e*, to an approximately horizontal attitude, to the negatively acute inclination (obliquely descending attitude) shown in FIG. 2*f*.

Referring to FIG. 2*f*, the main propulsion motor 56 (diagrammatically represented in FIG. 1) of air vehicle 14 starts during descent of air vehicle 14. Air vehicle 14 proceeds on flight path after sufficient air speed is developed.

Particularly with reference again to FIG. 1, FIG. 2*b*, FIG. 2*c* and FIG. 3, separation of air vehicle 14 from lauch canister 12 can be accomplished in a manner which is similar to but distinguishable from that which is described herein in association with rocket motor 42 and motor ignitor 44. A variety of booster-type devices and other propulsive apparatuses can be implemented in inventive practice. Air vehicle 14 can be propelled from canister 12 in any manner known to man, including mechanically, electrically, chemically or some combination thereof.

For instance, some inventive embodiments implement an internal spring 42 and an electrical solenoid 44, respectively, instead of a rocket motor 42 and a motor ignitor 44. According to such inventive embodiments, the control system would be similar to that described hereinabove, except that internal spring 42 replaces rocket motor 42 as the propulsor, and electrical solenoid 44 replaces rocket motor ignitor 44 as the propulsion actuator. Hence, pressure transducer 32 transmits to controller 36 a signal informing of the pressure change corresponding to the change from water to air. In response to this signal, controller 36 turns on switch 38 and sends electrical current from battery 40 to electrical solenoid 44, whereupon internal spring 42 activates.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. Apparatus comprising a canister, an air vehicle, discharge means and sensing means;

said air vehicle having a fore vehicle end and an aft vehicle end, said sensing means being operatively connected to said canister, said sensing means being capable of sensing a physical change associated with the desubmergence of at least a portion of said canister, said sensing means being capable of sending a communication in accordance with said physical change, said discharge means being situated at said aft vehicle end and being capable of activation, as a result of said communication sent by said sensing means, so as to propel said air vehicle in a forward direction;

said canister including an approximately cylindrical body and a nose cone, said body including an interior space for containing said air vehicle, said interior space being characterized by an upper interior space end and a lower interior space end, said upper interior space end being open, said lower interior space end being closed, said interior space having an transverse interior space surface portion at said lower interior space end, said nose cone including a generally conical section and an approximately cylindrical shoulder section, said conical section having a generally narrower conical end and a generally wider conical end, said shoulder section protecting from said conical section at said wider conical end, said shoulder section including an approximately circular bottom shoulder surface portion, said shoulder section having an approximate shoulder diameter, said conical section having an approximate wider conical diameter at said wider conical end, said body having an approximate body diameter, said shoulder diameter being less than said wider conical diameter and being less than said body diameter;

said body and said nose cone being capable of being securely coupled with each other so that said shoulder section fits inside a portion of said interior space at said upper interior space end, so that said conical section and said cylindrical body are approximately flush, so that said conical section, said shoulder section and said body are each approximately symmetrical with respect to the same imaginary longitudinal axis, so that said transverse interior space surface portion and said bottom shoulder surface portion each approximately define a plane which is approximately perpendicular with respect to said imaginary longitudinal axis, and so that said interior space accommodates said air vehicle;

when said body and said nose cone are securely coupled with each other, said air vehicle being adaptable to containment in said interior space, and said body and said nose cone being capable of being uncoupled from each other, so that said fore vehicle end is in the vicinity of said upper interior space end, so that said aft vehicle end is in the vicinity of said lower interior space end, and so that, as a result of said activation of said discharge means, said body and said nose cone are capable of being uncoupled from each other whereby said air vehicle separates from said body and said nose cone, wherein upon said activation of said discharge means said discharge means exerts an aftward force and said fore vehicle end exerts a forward force, said aftward force being exerted by said discharge means against said transverse interior space surface portion, said forward force being exerted by said fore vehicle end against said bottom shoulder surface portion, said aftward force and said forward force thereby causing said uncoupling of said body and said nose cone whereby said air vehicle separates from said body and said nose cone;

when said body and said nose cone are securely coupled with each other, said canister being capable of liquid buoyantly propelled upward movement and being adaptable to being released from a submerged location, said canister, in association with said liquid buoyantly propelled upward movement of said canister, being characterized by a shape which at least substantially minimizes drag and at least substantially maximizes stability.

2. Apparatus as in claim 1, wherein said sensing means includes means for sensing the pressure change associated with the desubmergence of at least a portion of said structure.

3. Apparatus as in claim 2, wherein said apparatus comprises means for initiating said activation of said discharge means, wherein said means for initiating receives said communication from said sensing means.

4. Apparatus as in claim 3, wherein said apparatus comprises means for releasing said canister from said submerged location.

5. Apparatus as in claim 1, wherein:

said buoyantly propelled upward movement approximately defines a vertical direction;

said canister includes stabilization means; and said imaginary longitudinal axis and said vertical direction are approximately coincident.

6. Apparatus as in claim 1, wherein:

said buoyantly upward movement is approximately vertical;

said canister includes stabilization means; and the orientation of said canister is approximately vertical, said conical section up, during said liquid buoyantly upward movement.

7. Apparatus as in claim 6, wherein said stabilization means includes a plurality of fins.

8. Apparatus as in claim 7, wherein said body has an upper body end and a lower body end;

said nose cone is situated at said upper body end; and said fins are situated in the vicinity of said lower body end.

9. Apparatus as in claim 2, wherein said means for sensing the pressure change is situated in said nose cone.

10. Apparatus as in claim 9, wherein said pressure change is associated with the desubmergence of at least a portion of said conical section of said nose cone.

11. Apparatus as in claim 10, wherein said apparatus comprises control means, wherein said control means includes means for initiating said activation of said discharge means, and wherein said means for initiating receives said communication from said sensing means.

12. Apparatus as in claim 11, wherein said air vehicle is a winged air vehicle, said winged air vehicle including a fuselage and at least two aero structures, said at least two aero structures being selected from the group consisting of wing, flap, aileron and rudder, said at least two aero structures being capable of compliancy in order that said interior space of said canister accommodate said winged air vehicle when said body and said nose cone are securely coupled with each other, said compliancy being selected from the group consisting of movability, adjustability, retractability, rotatability, pivotability, flexibility and foldability, said at least two aero structures being capable of decompliancy after said winged air vehicle separates from said body and said nose cone.

13. Apparatus as in claim 8, wherein:

said sensing means includes means for sensing the pressure change associated with the desubmergence of at least a portion of said structure, said means for sensing the pressure change being situated in said nose cone;

said communication sent from said sensing means is a first communication;

said apparatus comprises control means situated in said body, said control means being capable of receiving said first communication from said sensing means;

said control means is capable of sending a second communication in accordance with said first communication; and said discharge means is capable of receiving said second communication from said control means.

14. Apparatus as in claim 13, wherein:

said control means includes a controller, a switch and a power supply;

said discharge means includes a propulsor and an actuator for said propulsor;

said means for sensing the pressure change is capable of sensing pressure change associated with environmental change from water to air;

said sensing means is capable of informing said controller of said pressure change, said first communication including said informing said controller of said pressure change; and said controller is capable, upon being informed of said pressure change, of opening said switch, whereupon electrical current flows from said power supply to said actuator, said second communication including said electrical current flowing from said power supply to said actuator.

15. Apparatus as in claim 14, wherein:

said power supply includes a battery;

said propulsor includes a rocket motor; and said actuator includes an ignitor for said rocket motor.

16. Apparatus as in claim 14, wherein:

said power supply includes a battery;

said propulsor includes a spring; and said actuator includes a solenoid.

17. A system for launching a vehicle from an aquatic environment to an aerial environment, said vehicle having a front vehicle area and a back vehicle area, said system comprising:

a canister for containing said vehicle, said canister being configured in furtherance of reducing drag and increasing stability in relation to the upward motivation of said canister by a buoyant force in said aquatic environment;

a device for releasing said canister from a location in said aquatic environment, thereby permitting said upward motivation of said canister; and a propulsor for propelling said vehicle from said canister after the transition of said canister from said aquatic environment to said aerial environment, said propulsor being attachable to said vehicle at said back vehicle area;

said canister including a cylindroid member and a nose cone member, said cylindroid member having a cavity and an opening into said cavity, said cavity having an extreme wall opposite said opening, said cylindroid member having a first cylindroid end and a second cylindroid end, said opening being located at said first cylindroid end, said extreme wall being located between said first cylindroid end and said second cylindroid end, said nose cone member including a generally cone-shaped portion and an approximately cylindrical projection axially aligned with said cone-shaped portion, said projection including an approximately round end face, said cylindroid member and said nose cone member being joinable and disjoinable;

said cylindroid member and said nose cone member being joinable whereby:

said projection is approximately fully inserted into said cavity at said opening;

a portion of said cavity is unoccupied by said projection; and said vehicle is containable in said unoccupied portion of said cavity, said front vehicle area being located proximate said end face of said projection, said back vehicle area being located proximate said extreme wall of said cavity;

said cylindroid member and said nose cone member being disjoinable whereby:

said propulsor by said propelling effects pushing against said extreme wall of said cavity;

said front vehicle area contactingly pushes against said end face of said projection; and said vehicle separates from said cylindroid member and said nose cone member.

18. A system for launching as in claim 17, comprising:

an actuator for said propulsor;

a battery;

a switch for closing the electric circuit between said battery and said actuator;

a pressure transducer for transmitting a signal to said controller in relation to said transition; and a controller for activating said switch upon receipt of said signal.

19. A system for launching as in claim 18, wherein said propulsor includes a rocket motor, and wherein said actuator includes a rocket ignitor.

20. A system for launching as in claim 18, wherein said propulsor includes a spring device, and wherein said actuator includes a solenoid.

21. A system for launching as in claim 20, wherein said device is a nonexplosive mechanical device, wherein said canister includes plural stabilizing foils, wherein said propulsor is a booster propulsor, and wherein said system comprises a main propulsor for said vehicle, said main propulsor commencing operation upon termination of operation of said booster propulsor.

22. A method for launching an object from a site below the surface of a body of water, said object having a front object region and a back object region, said method comprising:

providing an enclosure, said enclosure being contoured for promoting hydrodynamic efficiency when impelled by buoyancy, said enclosure including a cylindroid structure and a nose cone structure, said cylindroid structure having a chamber and an opening into said chamber, said chamber having an extreme wall opposite said opening, said cylindroid structure having a first cylindroid end and a second cylindroid end, said opening being located at said first cylindroid end, said extreme wall being located between said first cylindroid end and said second cylindroid end, said nose cone structure including a generally cone-shaped portion and an approximately cylindrical projection axially aligned with said cone-shaped portion, said projection including an approximately round end face, said cylindroid structure and said nose cone structure being joinable and disjoinable;

associating propulsion apparatus with said object at said back object region, said propulsion apparatus being for propelling said object;

associating sensing apparatus with said enclosure at said nose cone structure, said sensing apparatus being for sensing fluid pressure relating to the fluid external to said enclosure;

placing said object in said chamber;

joining said cylindroid member and said nose cone member, so that:

said projection is approximately fully inserted into said chamber at said opening;

a portion of said chamber is unoccupied by said projection; and said object is positioned in said unoccupied portion of said chamber, said front object region being located proximate said end face of said projection, said back object region being located proximate said extreme wall of said chamber;

releasing said enclosure from said site, said object enclosed, so that said enclosure is buoyantly impelled to rise toward, through and above said surface;

sensing fluid pressure relating to the fluid external to said enclosure; and propelling said object from said enclosure once said enclosure has risen above said surface, so that:

said propulsion apparatus, through said propelling, exerts a force against said extreme wall of said chamber;

said front object region comes into contact with, and exerts a force against, said end face of said projection;

said cylindroid member and said nose cone member are disjoined, due to said exertion of force by said propulsion apparatus, and due to said exertion of force by said front object region; and said object separates from said cylindroid member and said nose cone member.

23. A method for launching as in claim 22, wherein said object is a winged aircraft having a plurality of wings, said method comprising providing said winged aircraft so as to be characterized by adjustability of said wings for permitting said enclosing of said winged aircraft in said enclosure.

24. A method for launching as in claim 23, comprising:

providing said sensing apparatus for said sensing;

providing said propulsion apparatus for said propelling; and providing control apparatus for:

communicating with said sensor and with said propulsion apparatus;

receiving, from said sensor, information pertaining to said sensing; and controlling said propulsion apparatus based on said information, whereby said propelling is performed when said fluid external to said enclosure is air.

25. A method for launching as in claim 24, wherein:

said method comprises, prior to said releasing, evaluating the speed of said enclosure at about the time that said enclosure reaches said surface, said evaluating including regarding at least one factor selected from the group of factors consisting of:

distance of said site below said surface;

size of said enclosure;

shape of said enclosure; and mass distribution of said enclosure; and said releasing includes selecting said site in consideration of said evaluating.

26. A method for launching as in claim 22, wherein said method comprises providing said object, wherein said object is selected from the group of objects consisting of missile, rocket, projectile, unmanned helicopter, manned helicopter, unmanned winged aircraft and manned winged aircraft.

27. A method for launching as in claim 23, wherein said winged aircraft is capable of self-propulsion suitable for sustained flight, and wherein said method comprises, after propelling said winged aircraft from said enclosure, causing said self-propulsion to commence.

* * * * *